US006112558A

United States Patent [19]

Wang

[11] Patent Number: 6,112,558

[45] Date of Patent: Sep. 5, 2000

[54] COMPUTER-CONTROLLED GROUND MESH JACQUARD KNITTING MACHINE

[75] Inventor: Ping-Shin Wang, Taipei Hsien, Taiwan

[73] Assignee: Pai Lung Machinery Mill Co., Ltd., Taiwan

[21] Appl. No.: 09/352,769

[22] Filed: Jul. 14, 1999

[51] Int. Cl.[7] ..... D04B 15/38

[52] U.S. Cl. ..... 66/222; 66/125 B

[58] Field of Search ..... 66/216, 222, 223, 66/224, 225, 226, 227, 219, 220, 221, 116, 123, 125 R, 125 B, 138

[56] References Cited

U.S. PATENT DOCUMENTS

| | | | |
|---|---|---|---|
| 4,036,033 | 7/1977 | Jesson | 66/14 |
| 4,860,557 | 8/1989 | Guell | 66/14 |
| 5,127,241 | 7/1992 | Plath | 66/141 |

*Primary Examiner*—Danny Worrell
*Attorney, Agent, or Firm*—Bacon & Thomas PLLC

[57] ABSTRACT

A computer-controlled ground mesh jacquard knitting machine. The machine includes a set of yarn feeders supported on the machine base, a set of needles mounted on a needle cylinder, a set of first needle jacks respectively coupled to the needles, a set of second needle jacks respectively coupled to the first needle jacks, a lifting cam device controlled to lift the needles and the first needle jacks. The lifting cam device includes needle lifting guide blocks and flat guide blocks and needle descending guide blocks respectively arranged in an outertrack thereof, and the needle lifting guide blocks are arranged in an inner track thereof, and a needle selector is mounted below the lifting cam device, wherein the needle selector is controlled to selectively drive the second needle jacks when the needles and the first needle jacks are moved by the lifting device causing the needles to achieve a ground mesh jacquard knitting operation.

4 Claims, 11 Drawing Sheets

COMPUTER-CONTROLLED GROUND MESH JACQUARD KNITTING MACHINE

BACKGROUND OF THE INVENTION

1. Field of the Invention

The present invention relates to a computer-controlled ground mesh jacquard knitting machine, and more particularly to such a computer-controlled ground mesh jacquard knitting machine in which each yarn feeder has a recessed portion for receiving a corresponding color changing head.

2. Description of the Prior Art

Most knitting machine manufacturers try hard to improve jacquard knitting techniques, so as to knit out versatile jacquard fabrics. In order to produce a colorful jacquard pattern, color changing heads are installed to provide different color yarns. When color changing heads are used, the yarn feeders must be removed from the jacquard knitting machine. If the color changing heads are directly installed in the jacquard knitting machine without removing the yarn feeders, the yard feeders will be damaged by the yarn changing board at each color changing head.

SUMMARY OF THE INVENTION

The present invention has been accomplished to provide a computer-controlled ground mesh jacquard knitting machine, which eliminates the aforesaid problem. According to the present invention, the yarn feeders each have a recessed portion. When color changing heads are installed, they are respectively received in the recessed portion at each yarn feeder. Therefore, the yarn feeders and the color changing heads can be concomitantly installed in the jacquard knitting machine without causing any trouble.

DETAILED DESCRIPTION OF THE PREFERRED EMBODIMENT

Figure 1A:
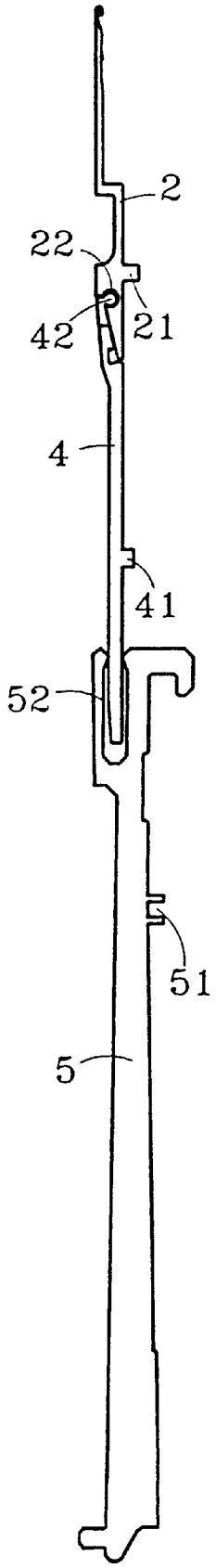
FIGS. 1A~1C illustrate relative positions of the needles, the first needle jacks, the second needle jacks, the lifting cams, and the needle selector according to the present invention.
Figure 1B:
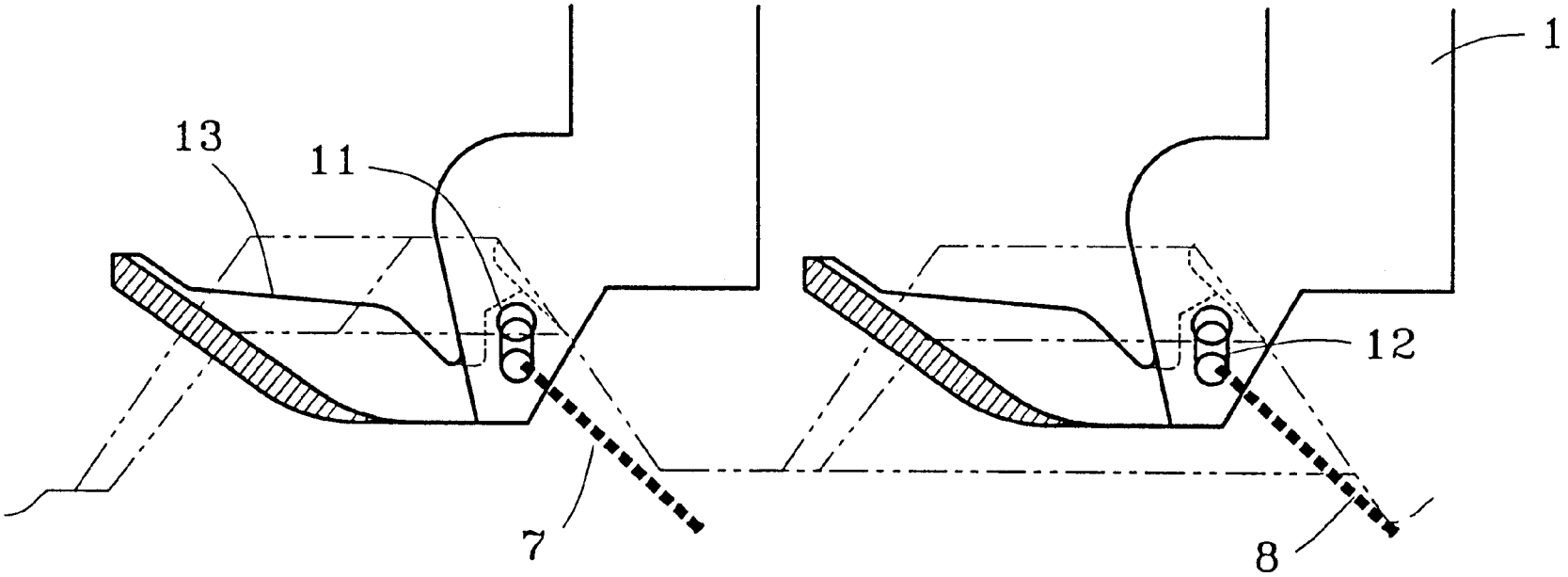
Figure 1C:
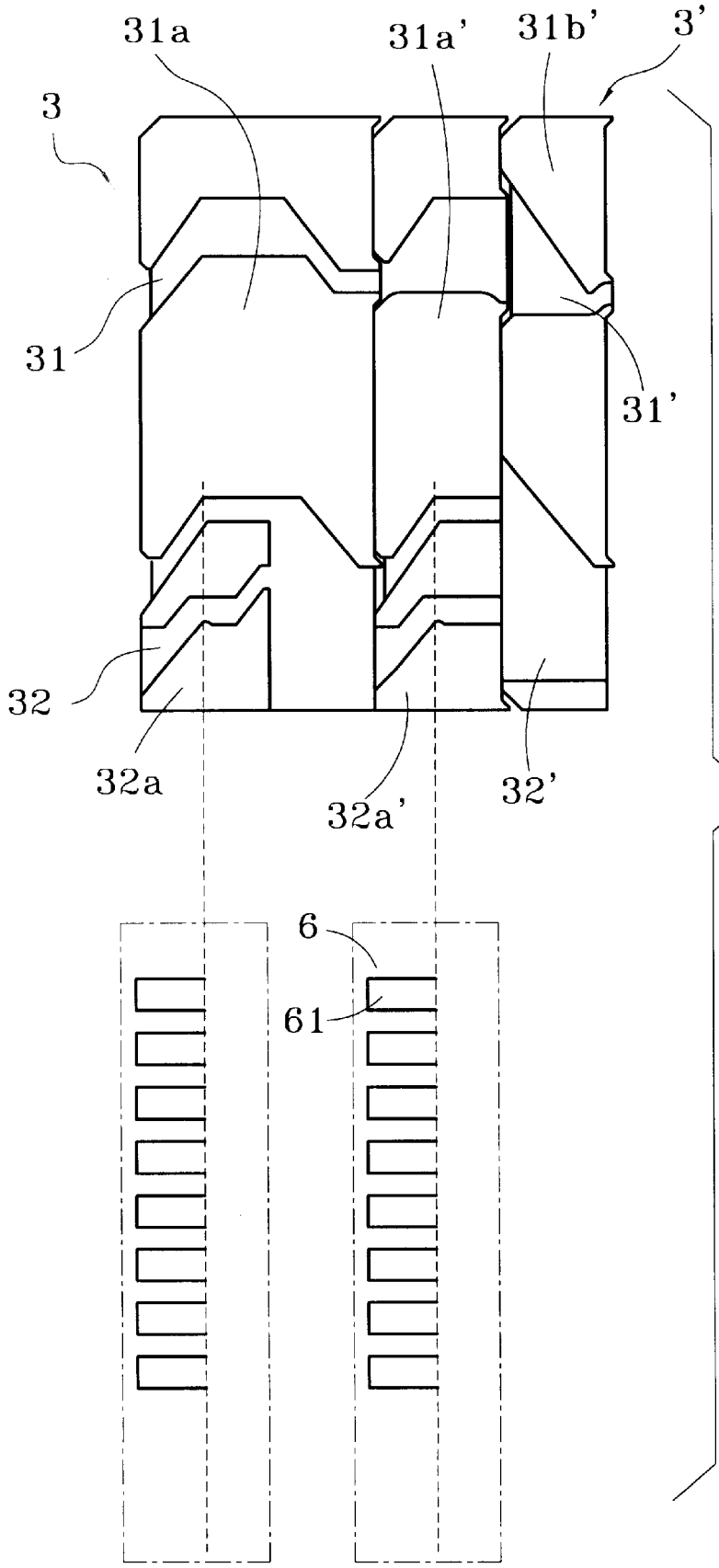

Referring to Figures from 1A through 1C, a computer-controlled ground mesh jacquard knitting machine is shown comprised of a set of yarn feeders 1 supported on the machine base (not shown) thereof, a set of needles 2 mounted in the needle cylinder (not shown), a set of first needle jacks 4 respectively coupled to the needles 2 at the bottom side, a set of second needle jacks 5 respectively coupled to the first needle jacks 4 at the bottom side, pairs of lifting cams 3 and 3' controlled to lift the first needle jacks 4 and the needles 2, and a needle selector 6 mounted in a cap (not shown) and controlled to selectively lift the second needle jacks 5.

The yarn feeders 1 each comprise a thread hole 11 or 12 through which a ground yarn 7 or face yarn 8 is inserted, a recessed portion 13, and a ceramic bore 14. The needles 2 each comprise a needle heel 21, and a coupling portion 22 adjacent to the needle heel 21. The first needle jacks 4 each comprise a butt 41, and a front coupling portion 42 coupled to the coupling portion 22 at one of the needles 2. The second needle jacks 5 each comprise a butt 51, and a front receptacle 52, which receives the rear end of one of the first needle jacks 4. The pairs of lifting cams 3 and 3' each include a first lifting cam 3 and a second lifting cam 3'. The first lifting cam 3 comprises an outer track 31, an inner track 32, a first projecting block 31*a* in the outer track 31, and a second projecting block 32*a* in the inner track 32. The second lifting cam 3' comprises an outer track 31', an inner track 32', a first projecting block 31*a'* and a second projecting block 31*b'* in the outer track 31', and a third projecting block 32*a'* in the inner track 32.

The needle selector 6 is controlled by an external computer, comprising a plurality of selection jacks 61 corresponding to the second needle jacks 5. The selection jacks 61 are selectively moved between a horizontal position and a vertical position. When one selection jack 61 is moved to the horizontal position, it is stopped below the butt 51 at the corresponding second needle jack 5, for enabling the corresponding second needle jack 5 to be moved to lift the corresponding first needle jack 4 and the corresponding needle 2.

Figure 2:
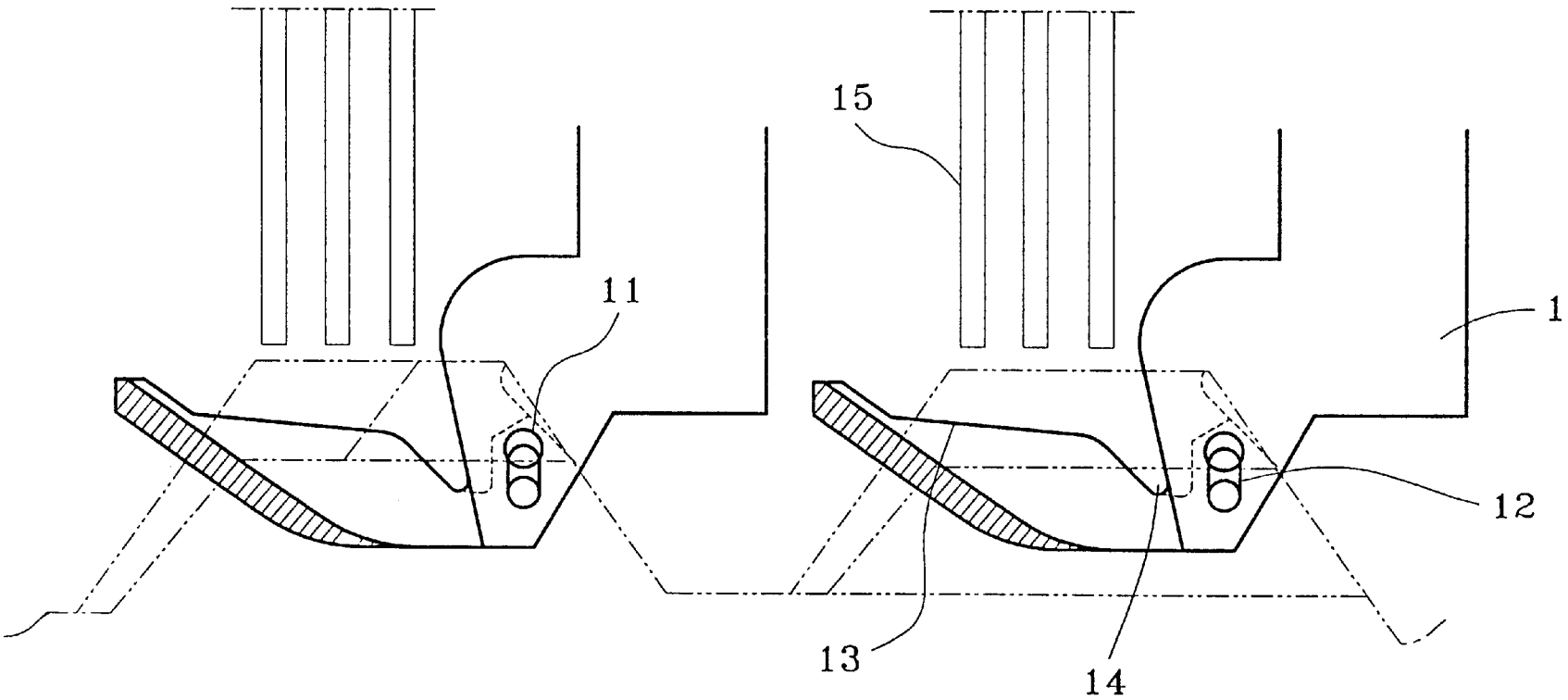
FIG. 2 is an enlarged view of a part of a yarn feeder according to the present invention.

Referring to FIG. 2, the recessed portion 13 at each of the yarn feeders 1 is provided to receive corresponding color changing heads 15 of a color changing unit of the computer-controlled ground mesh jacquard knitting machine, therefore the yard feeders 1 do not hinder the color changing heads 15. Further, the ceramic bore 14 is provided at the bottom end of the recessed portion 13. When using the computer-controlled ground mesh jacquard knitting machine to knit an elastic fabric, elastic yarn can be arranged in the ceramic bore 14.

Figure 3A:
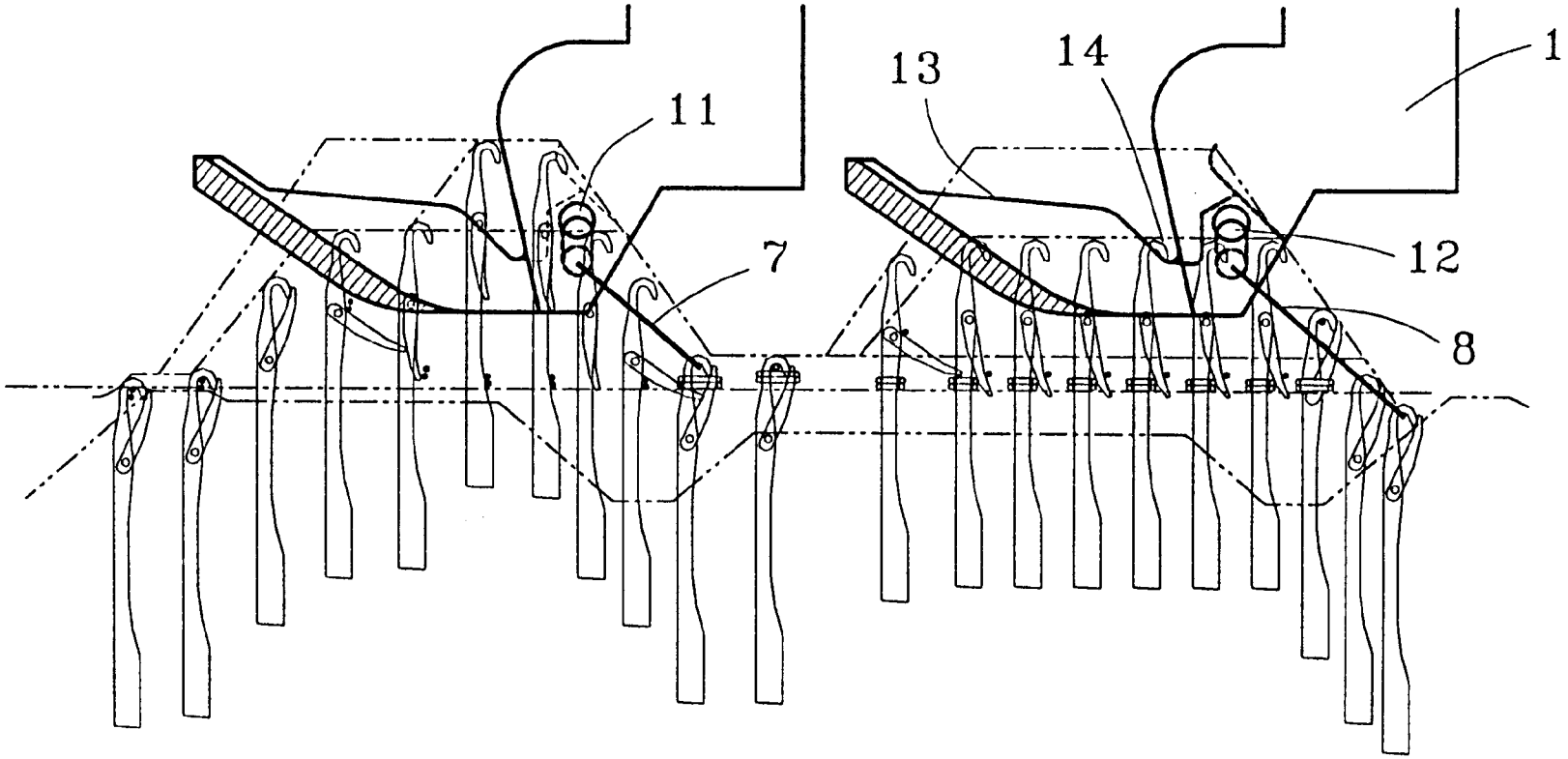
FIGS. 3A and 3B illustrate an action of the needles in the lifting cams.
Figure 3B:
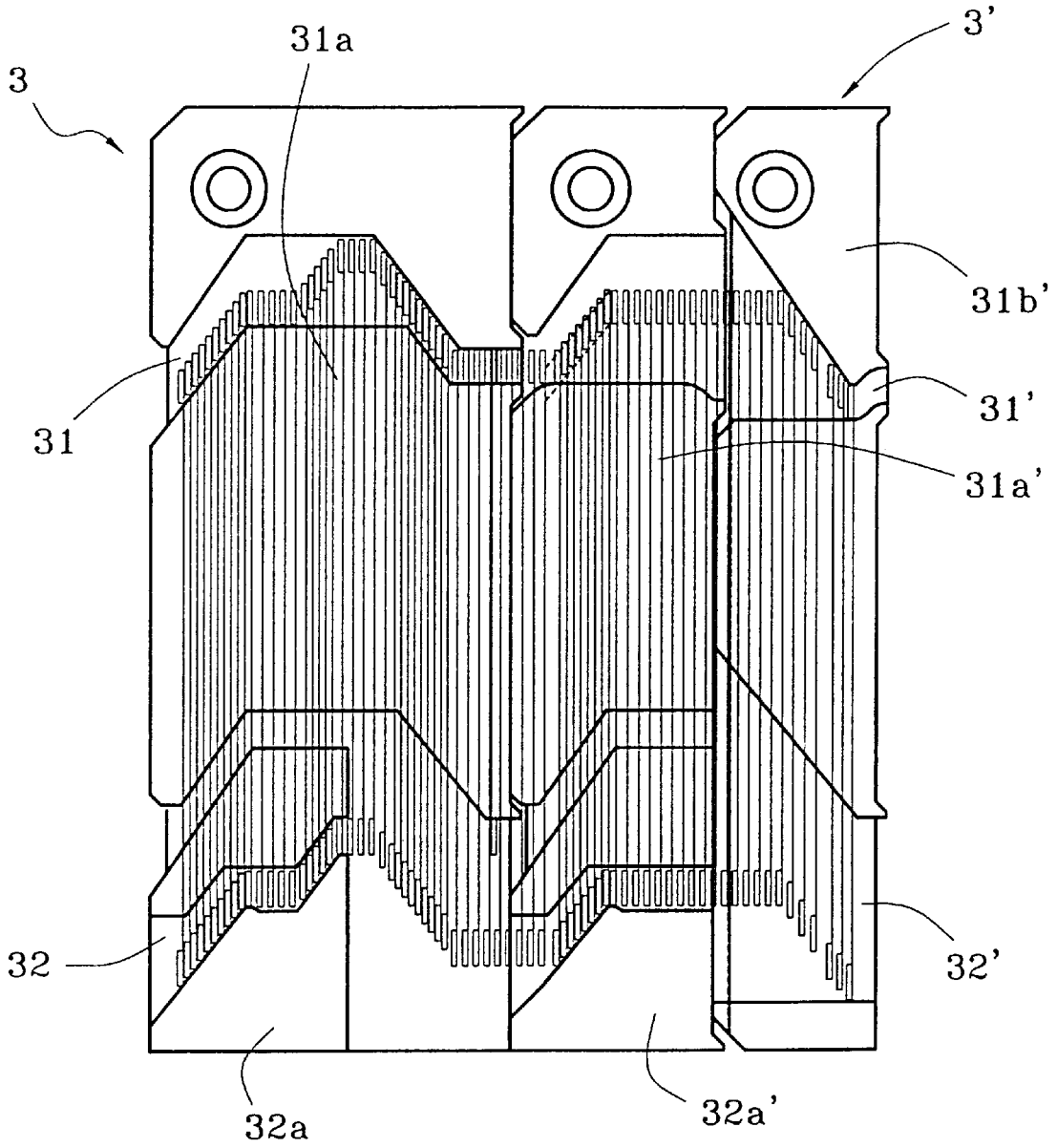
Figure 6:
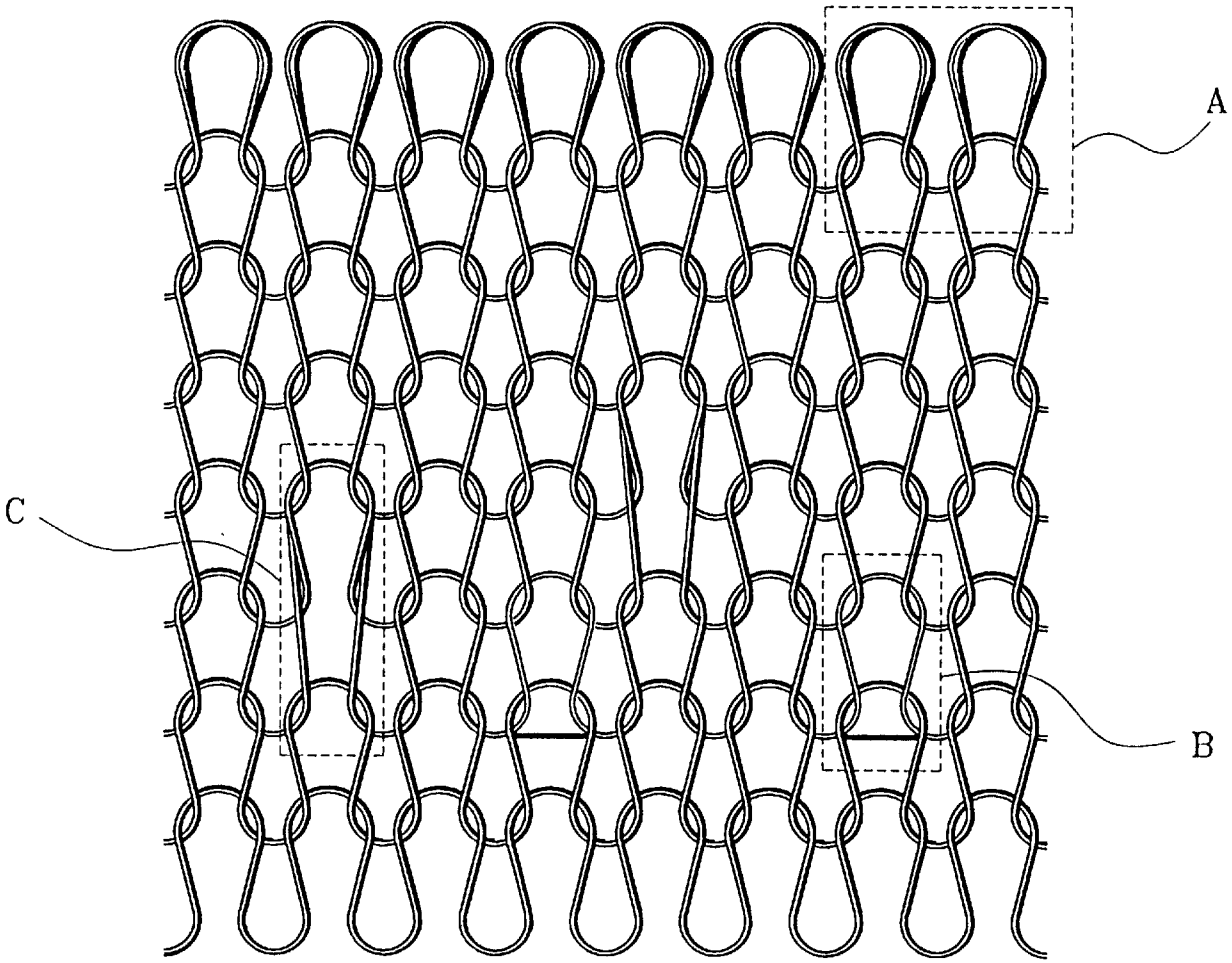
FIG. 6 is an enlarged view of a ground mesh jacquard fabric knitted according to the present invention.

Referring to FIGS. 3A and 3B, the lifting cams 3 and 3' are rotated by the knitting machine, the needle heel 21 of each needle 2 and the butt 41 of each first needle jack 4 are respectively moved in the outer track 31 and inner track 32 at one first lifting cam 3, and the needle heel 21 of each needle 2 is moved over the left slope of the second projecting block 32*a* at the corresponding first lifting cam 3, thereby causing the needle 2 to be lifted. Thereafter, each needle 2 is lowered along the first projecting block 31*a* at the corresponding first lifting cam 3 to take a ground yarn 7. Then, the needle heel 21 of each needle 2 and the butt 41 of each first needle jack 4 are respectively moved in the outer track 31' and inner track 32' at one second lifting cam 3', and the needle heel 21 of each needle 2 is moved over the left slope of the third projecting block 32*a'* at the corresponding second lifting cam 3', thereby causing the needle 2 to be lifted, and then the needle 2 is moved along the second projecting block 31*b'* in the outer track 31' at the corresponding second lifting cam 3' to achieve part A shown in FIG. 6.

Figure 4A:
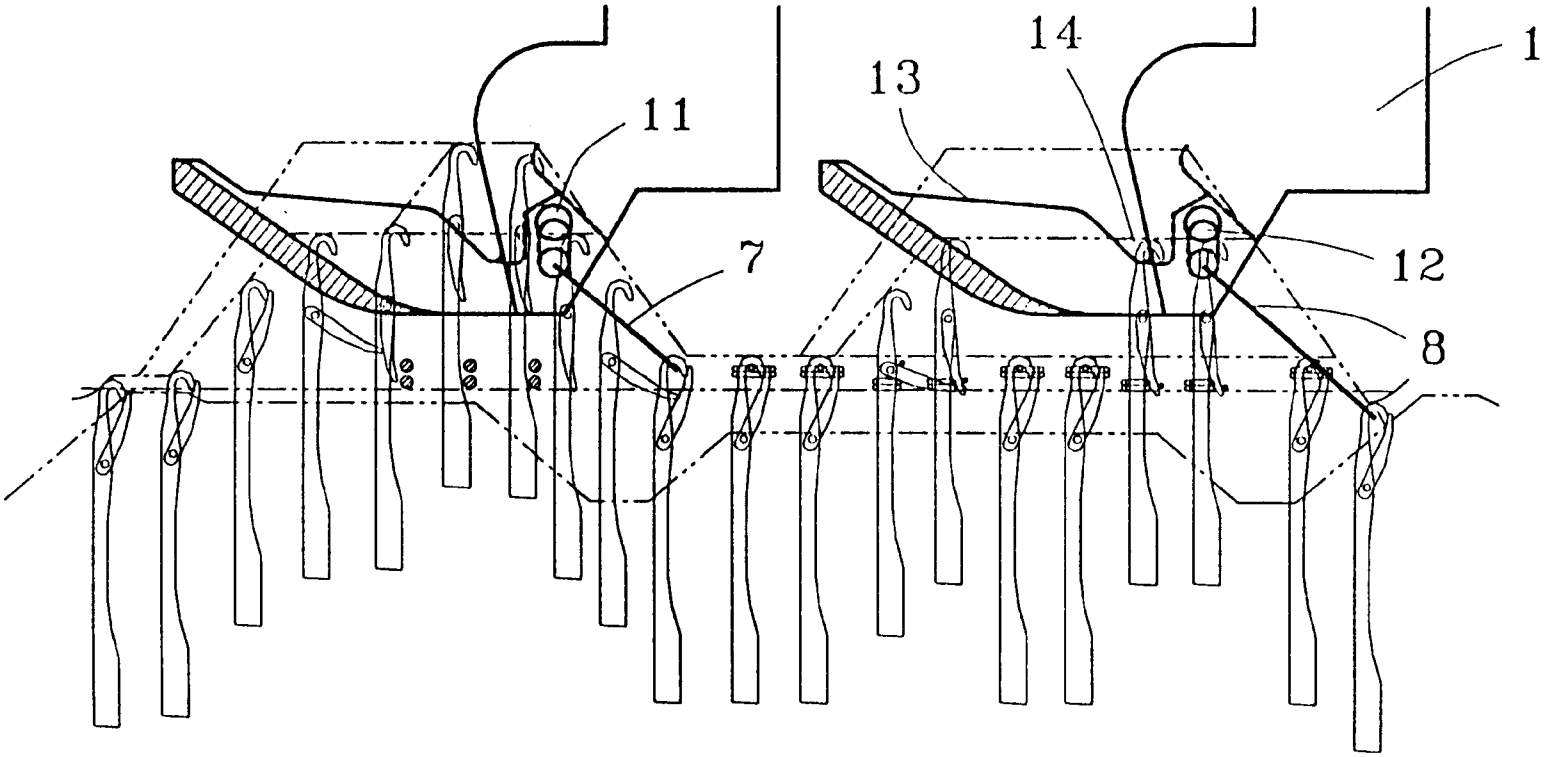
FIGS. 4A and 4B illustrate another action of the needles in the lifting cams.
Figure 4B:
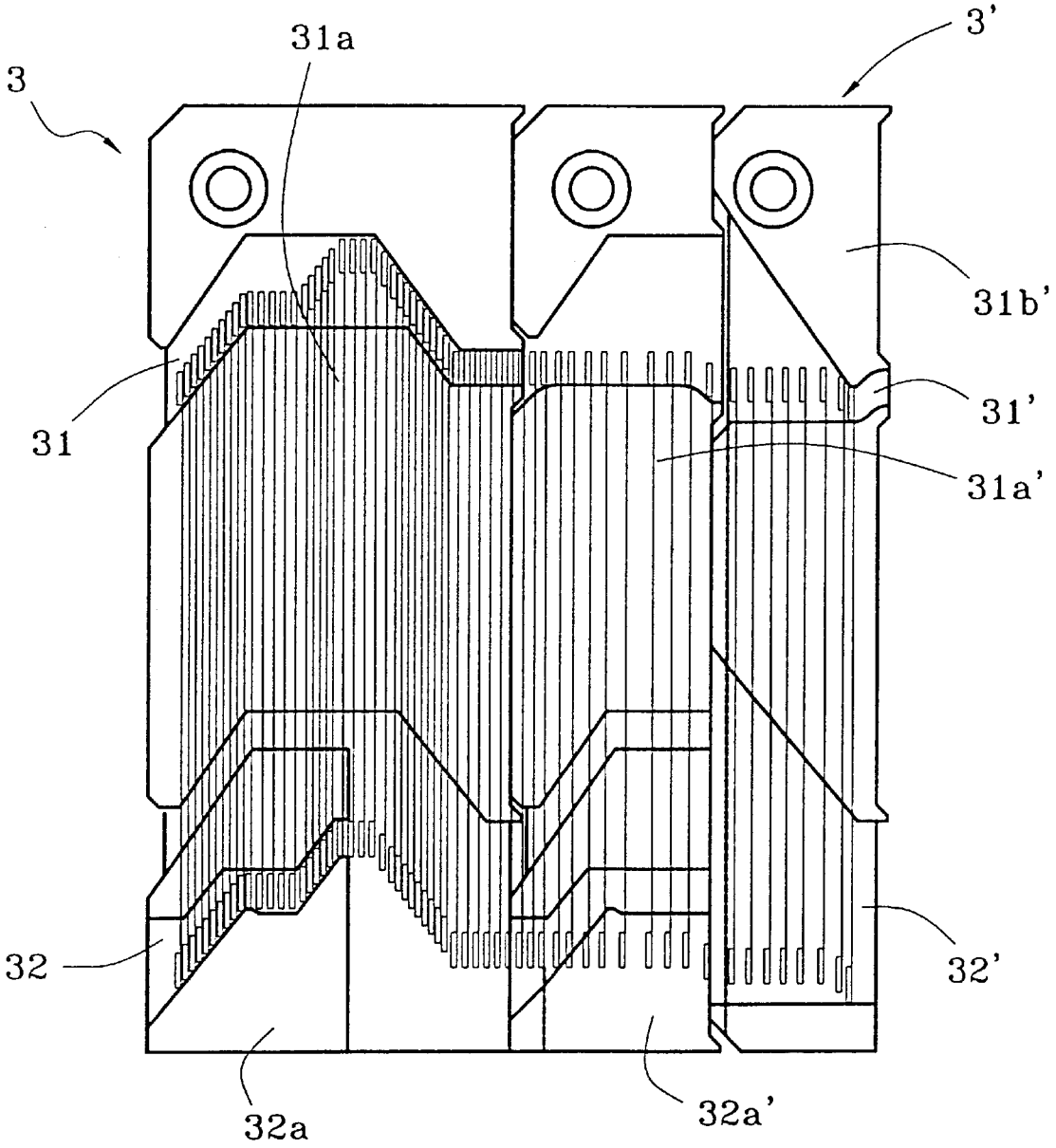

Referring to FIGS. 4A and 4B, after passing through the corresponding first lifting cam 3, the needle heel 21 of each needle 2 and the butt 41 of each first needle jack 4 are respectively moved in the outer track 31' and inner track 32' at one second lifting cam 3'. When each needle 2 is moved along the first projecting block 31*a'* at one second lifting cam 3', the selection jacks 61 of the needle selector 6 are at the needle section status, and selected selection jacks 61 are respectively stopped at the butt 51 of each of the second needle jacks 5 to lift the second needle jacks 5 and the first needle jacks 4, and therefore the butt 41 of each of the first needle jacks 4 is respectively spaced above the third projecting block 32*a*' at each of the second lifting cams 3', i.e., each needle 2 is moved through the outer side of the corresponding third projecting block 32*a*' and then lowered along the corresponding second projecting block 31*b*' to complete an idle knitting stroke, i.e., to achieve a ground mesh jacquard knitting (see part B shown in FIG. 6).

Figure 5A:
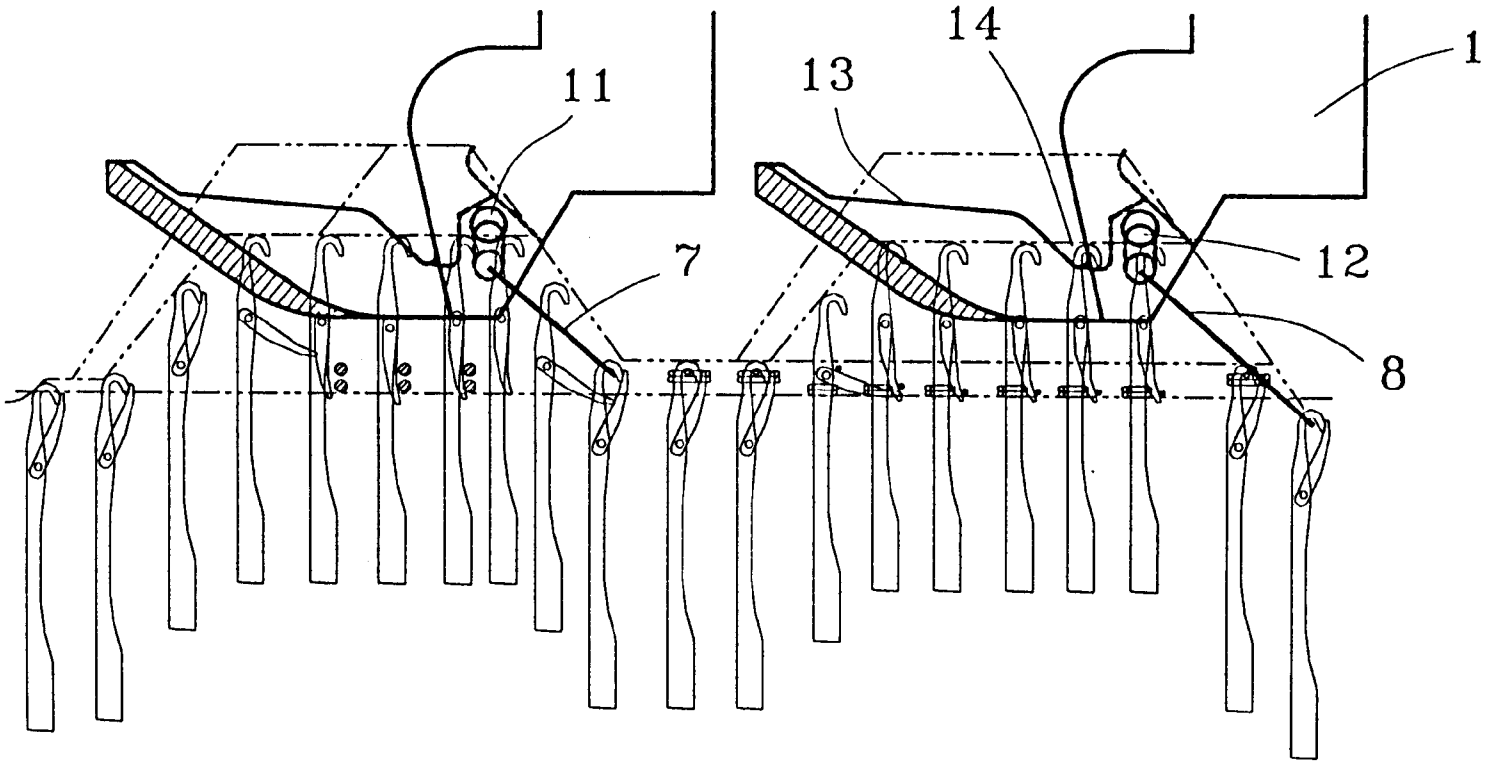
FIGS. 5A and 5B illustrate still another action of the needles in the lifting cams.
Figure 5B:
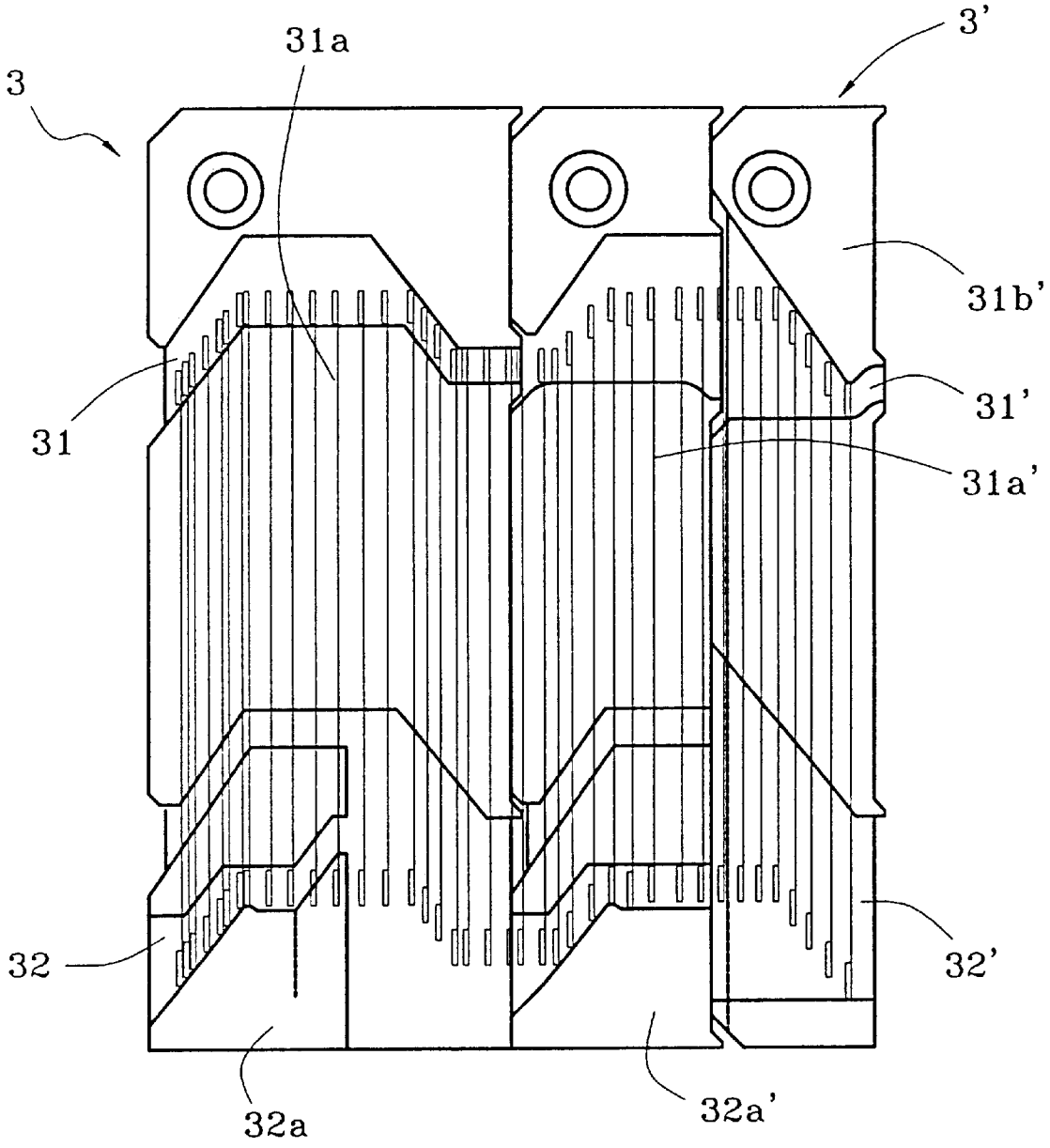

Referring to FIGS. 5A and 5B, when the needle heel 21 of each needle 2 and the butt 41 of each first needle jack 4 are respectively moved in the outer track 31 and inner track 32 at one first lifting cam 3, and the needle heel 21 of each needle 2 is moved over the left slope of the second projecting block 32*a* at the corresponding first lifting cam 3, each needle 2 is lifted, and then moved toward the first projecting block 31*a* at the corresponding first lifting cam 3. When the needle heel 21 of one needle 2 is lifted to the flat surface portion of the corresponding first projecting block 31*a* and the corresponding selection jack 61 is selected, the butt 51 of the corresponding needle jack 5 is pushed upwards by the corresponding selection jack 6, thereby causing the corresponding first needle jack 4 to be lifted from the second projecting block 32*a*, therefore the needle 2 is moved through the outer side of the corresponding second projecting block 32*a*, and thereafter, the needle 2 is lowered along the corresponding first projecting block 31*a* to take a ground yarn 7, and then the needle heel 21 of the needle 2 and the butt 41 of the corresponding first needle jack 4 are respectively moved in the outer track 31' and inner track 32' at the corresponding second lifting cam 3', and the needle heel 21 of each needle 2 is moved over the left slope of the third projecting block 32*a*' at the corresponding second lifting cam 3', thereby causing the needle 2 to be lifted, and then the needle 2 is lowered along the second projecting block 31*b*' in the outer track 31' at the corresponding second lifting cam 3' to take a face yarn 8, so as to achieve part C shown in FIG. 6.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. A computer-controlled ground mesh jacquard knitting machine comprising:

a set of yarn feeders, said yarn feeders each comprising a recessed portion configured to receive corresponding color changing heads of the jacquard knitting machine;

a set of needles mounted on a needle cylinder in the jacquard knitting machine, the needles each having a bottom side;

a set of first needle jacks corresponding to said needles, the first needle jacks coupled to said needles at the bottom side thereof;

a set of second needle jacks respectively coupled to said first needle jacks at a bottom side;

a lifting cam device computer-controlled to lift said needles and said first needle jacks, said lifting cam device comprising an outer track and an inner track, said outer track comprising needle lifting guide blocks, flat guide blocks and needle descending guide blocks respectively arranged in sequence, said inner track comprising said needle lifting guide blocks; and a needle selector mounted below said lifting cam device;

wherein said lifting cam device is driven to move said needles and said first needle jacks, and said needle selector is computer-controlled to selectively drive said second needle jacks, causing the corresponding first needle jacks to be moved away from the descending guide blocks in said inner track, so as to achieve a ground mesh jacquard knitting effect.

2. The computer-controlled ground mesh jacquard knitting machine of claim 1 wherein said yarn feeders each includes a ceramic bore at a bottom end of the recessed portion.

3. The computer-controlled ground mesh jacquard knitting machine of claim 1 wherein a color change head is arranged above the recessed portion at each of said yarn feeders.

4. The computer-controlled ground mesh jacquard knitting machine of claim 2 wherein an elastic yarn is arranged in the recessed portion at each of said yarn feeders.

* * * * *